US005763372A

United States Patent [19]

Tersigni et al.

[11] Patent Number: 5,763,372

[45] Date of Patent: Jun. 9, 1998

[54] CLEAN GEAR BORON-FREE GEAR ADDITIVE AND METHOD FOR PRODUCING SAME

[75] Inventors: Samuel H. Tersigni, Ashland; Marsha J. Lester, Richmond; Lee D. Saathoff, Glen Allen, all of Va.

[73] Assignee: Ethyl Corporation, Richmond, Va.

[21] Appl. No.: 766,708

[22] Filed: Dec. 13, 1996

[51] Int. Cl.[6] ..... C10M 137/08; C10M 141/10

[52] U.S. Cl. ..... 508/436; 508/291; 508/436; 508/569

[58] Field of Search ..... 508/436

[56] References Cited

U.S. PATENT DOCUMENTS

| | | | |
|---|---|---|---|
| 3,793,199 | 2/1974 | Schlicht | 508/436 |
| 3,903,001 | 9/1975 | Gates et al. | 508/337 |
| 4,164,475 | 8/1979 | Schieman | 508/470 |
| 4,661,273 | 4/1987 | Frangatos et al. | 508/231 |
| 5,126,064 | 6/1992 | Barber et al. | 508/287 |
| 5,354,484 | 10/1994 | Schwind et al. | 508/192 |
| 5,358,650 | 10/1994 | Srinivasan et al. | 508/194 |
| 5,358,652 | 10/1994 | MacPherson | 508/271 |
| 5,360,562 | 11/1994 | Chrisope et al. | 508/192 |
| 5,387,352 | 2/1995 | Iyer | 508/423 |
| 5,410,088 | 4/1995 | Harris et al. | 508/323 |
| 5,492,638 | 2/1996 | Wallace et al. | 508/398 |
| 5,536,423 | 7/1996 | Miyagawa et al. | 508/436 |
| 5,665,685 | 9/1997 | Takigawa | 508/436 |

FOREIGN PATENT DOCUMENTS

| | | |
|---|---|---|
| 459656A1 | 12/1991 | European Pat. Off. . |
| 531000A1 | 3/1993 | European Pat. Off. . |
| 531585A1 | 3/1993 | European Pat. Off. . |
| 309481B1 | 3/1994 | European Pat. Off. . |
| 0 677 570 A1 | 10/1995 | European Pat. Off. . |
| 54-160402 A | 12/1979 | Japan . |
| 02032195 A | 2/1990 | Japan . |
| 02182787 A | 7/1990 | Japan . |
| 2 094 339 | 9/1982 | United Kingdom . |
| 9506094 | 3/1995 | WIPO . |

OTHER PUBLICATIONS

William F. Bland and Robert L. Davidson; *Petroleum Processing Handbook;* McGraw-Hill Book Co.; 1967.

*Primary Examiner*—Ellen M. McAvoy

*Attorney, Agent, or Firm*—Dennis H. Rainear; Thomas Hamilton

[57] ABSTRACT

The present invention relates to a clean gear boron-free gear additive employing a boron-free ashless dispersant, a sulfur source and a phosphorus source. More particularly, the preferred boron-free ashless dispersant is a hydrocarbyl succinimide. This additive composition when blended with a suitable base oil meets MT-1 and MIL-PRF-2105E requirements without the need for boron. MT-1 is a requirement for a clean gear manual transmission oil. MIL-PRF-2105E is a requirement for a rear axle oil.

26 Claims, No Drawings

CLEAN GEAR BORON-FREE GEAR ADDITIVE AND METHOD FOR PRODUCING SAME

BACKGROUND OF THE INVENTION

1. Field of the Invention

The present invention relates to a clear gear boron-free gear additive employing a boron-free ashless dispersant, a sulfur source and a phosphorus source. More particularly, the preferred boron-free ashless dispersant is a hydrocarbyl succinimide.

2. Background Discussion

The term "clean gear lubricating oil" is a term of art for lubricating oil which contains dispersant so that gears which it lubricates remain clean during use. Conventionally, clean gear manual transmission oil and rear axle oil employ dispersants to keep gears clean. However, the oils which are known to meet strict requirements such as MT-1 (an SAE standard for clean gear manual transmission oil) as well as MIL-PRF-2105E (a standard promulgated by the U.S. Army Tank Automotive and Armaments Command, Department of the Army, for rear axle oil) employ boronated dispersant. It would be desirable to employ non-boronated dispersant, but conventional wisdom believed boron was necessary for such oils.

U.S. Pat. No. 5,354,484 to Schwind et al discloses lubricating oil and functional fluid compositions containing a major amount of an oil of a lubricating viscosity and a minor amount of at least one soluble tertiary aliphatic primary amine salt of a substituted phosphoric acid and at least one soluble nitrogen-containing composition prepared by the reaction of a hydrocarbon-substituted succinic acid-producing compound with at least about one-half equivalent, per equivalent of acid producing compound, of an amine containing at least one hydrogen atom attached to a nitrogen atom. Preferably, U.S. Pat. No. 5,354,484 also discloses lubricant for gear assemblies of differentials consisting of a composition of the '484 patent and a substantially hydrocarbon polysulfide. However, U.S. Pat. No. 5,354,484 makes no mention of whether its oils meet the strict requirements MT-1 or MIL-PRL-2105E.

SUMMARY OF THE INVENTION

It is an object of the present invention to provide a clean gear capable boron-free gear additive which meets certain L-60-1 lubricant standards.

It is another object of the present invention to provide a method for making a gear oil or rear axle oil composition which is boron-free.

It is another object of the present invention to provide additive systems for a gear oil or rear axle oil composition.

The present invention relates to a clean gear capable boron-free gear additive. This is an additive for a gear oil or rear axle oil composition containing:

a boron-free nitrogen-containing ashless dispersant (component 1), a sulfur source (component 2), a phosphorus source (component 3) along with other optional ingredients. This additive composition when blended with a suitable base oil can unexpectedly meet MT-1 and MIL-PRF-2105E requirements without the need for boron. MT-1 is a requirement for a clean gear manual transmission oil. MIL-PRF-2105E is a requirement for a rear axle oil. In contrast, for this type of clean gear use, conventional oils are formulated with a boronated dispersant. The type of dispersant especially relates to L-60-1 tests common to both MT-1 and MIL-PRF-2105E. The L-60-1 test performance criteria include % viscosity increase, % pentane insolubles, % toluene insolubles, carbon/varnish rating and sludge rating.

The benefits of using a boron-free dispersant include: (i) a lower cost due to not having to add boron or to do additional processing to attach the boron to the dispersant, and (ii) no problems from precipitation of boron which detaches from the dispersant.

Component 1: Boron-Free Nitrogen-Containing Ashless Dispersants

Component 1 utilized in the compositions of this invention is comprised of the boron-free nitrogen-containing ashless dispersants. Thus, the composition contains at least one nitrogen-containing ashless dispersant such as a hydrocarbyl substituted succinimide, a hydrocarbyl substituted succinic acid, or a hydrocarbyl substituted succinamide.

The hydrocarbyl substituted succinimide is at least one soluble nitrogen-containing composition prepared by the reaction of a hydrocarbon-substituted succinic acid-producing compound (herein sometimes referred to as the "succinic acylating agent") with at least about one-half equivalent, per equivalent of acid-producing compound, of an amine containing at least one hydrogen attached to a nitrogen group. The nitrogen-containing compositions obtained in this manner are usually complex mixtures whose precise composition is not readily identifiable. Thus, the compositions generally are described in terms of the method of preparation. The nitrogen-containing compositions are sometimes referred to herein as "acylated amines". The nitrogen-containing compositions are either oil-soluble, or they are soluble in the oil-containing lubricating and functional fluids of this invention.

The soluble nitrogen-containing compositions useful in the lubricating compositions of the present invention are known in the art and have been described in many U.S. patents including U.S. Pat. Nos. 3,172,892; 3,215,707; 3,272,746; 3,316,177; 3,341,542; 3,444,170; 3,454,607; 3,541,012; 3,630,904; 3,632,511; 3,787,374; 4,234,435; and 5,354,484.

The above U.S. patents are expressly incorporated herein by reference for their teaching of the preparation of nitrogen-containing compositions. However, boron-containing compositions of any of these references are expressly excluded from the present invention.

In general, a convenient route for the preparation of the soluble nitrogen-containing compositions comprises the reaction of a hydrocarbon-substituted succinic acid-producing compound ("carboxylic acid acylating agent") with an amine containing at least one hydrogen attached to a nitrogen atom (i.e., H—N=). The hydrocarbon-substituted succinic acid-producing compounds include the succinic acids, anhydrides, halides and esters. The number of carbon atoms in the hydrocarbon substituent on the succinic acid-producing compound may vary over a wide range provided that the nitrogen-containing composition is soluble in the lubricating compositions of the present invention. Thus, the hydrocarbon substituent generally may contain an average of at least about 30 aliphatic carbon atoms and preferably contains an average of at least about 50 aliphatic carbon atoms. In addition to the oil-solubility considerations, the lower limit on the average number of carbon atoms in the substituent also is based upon the effectiveness of such compounds in the lubricating oil compositions of the present invention. The hydrocarbyl substituent of the succinic compound may contain polar groups if the polar groups are not present in proportions sufficiently large to significantly alter the hydrocarbon character of the substituent.

The sources of the substantially hydrocarbon substituent include principally the high molecular weight, substantially saturated, petroleum fractions and substantially saturated olefin polymers, particularly polymers of mono-olefins having from 2 to 30 carbon atoms per mono-olefin. The especially useful polymers are the polymers of 1-mono-olefins such as ethylene, propene, 1-butene, isobutene, 1-hexene, 1-octene, 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. They are illustrated by 2-butene, 3-pentene, and 4-octene.

Also useful are the interpolymers of the olefins such as those illustrated above with other interpolymerizable olefinic substances such as aromatic olefins, cyclic olefins, and polyolefins. Such interpolymers include, for example, those prepared by polymerizing isobutene with styrene; isobutene with butadiene; propene with isoprene; ethylene with piperylene; isobutene with chloroprene; isobutene with p-methyl styrene; 1-hexene with 1,3-hexadiene; 1-octene with 1-hexene; 1-heptene with 1-pentene; 3-methyl-1-butene with 1-octene; 3,3-dimethyl-1-pentene with 1-hexene; isobutene with styrene and piperylene; etc.

In preparing the substituted succinic acylating agents of this invention, one or more of the above-described polyalkylenes is reacted with one or more acidic reactants selected from the group consisting of maleic or fumaric reactants such as acids or anhydrides. Ordinarily the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepared the substituted succinic acid-producing compounds useful in the present invention. The especially preferred reactants are maleic acid, maleic anhydride, and mixtures of these. Due to availability and ease of reaction, maleic anhydride will usually be employed.

For convenience and brevity, the term "maleic reactant" is often used hereinafter. When used, it should be understood that the term is generic to acidic reactants selected from maleic and fumaric reactants. Also, the term "succinic acylating agents" is used herein to represent the substituted succinic acid-producing compounds.

One procedure for preparing the substituted succinic acylating agents of this invention is illustrated, in part, in U.S. Pat. No. 3,219,666 which is expressly incorporated herein by reference for its teachings in regard to preparing succinic acylating agents. This procedure is conveniently designated as the "two-step procedure". It involves first chlorinating the polyalkene until there is an average of at least about one chloro group for each molecular weight of polyalkene. For purposes of this invention, the molecular weight of the polyalkene is the weight corresponding to the number average molecular weight (Mn) value. Chlorination involves merely contacting the polyalkene with chlorine gas until the desired amount of chlorine is incorporated into the chlorinated polyalkene. Chlorination is generally carried out at a temperature of about 75° C. to about 125° C.

The second step in the two-step chlorination procedure, for purposes of this invention, is to react the chlorinated polyalkene with the maleic reactant at a temperature usually within the range of about 100° C. to about 200° C. The mole ratio of chlorinated polyalkene to maleic reactant is usually about 1:1. (For purposes of this invention, a mole of chlorinated polyalkene is that weight of chlorinated polyalkene corresponding to the Mn value of the unchlorinated polyalkene.) However, a stoichiometric excess of maleic reactant can be used, for example, a mole ratio of 1:2.

The resulting polyalkene-substituted succinic acylating agent is, optionally, again chlorinated if the desired number of succinic groups are not present in the product.

Another procedure for preparing substituted succinic acid acylating agents of the invention utilizes a process described in U.S. Pat. No. 3,912,764 and U.K. Patent No. 1,440,219, both of which are expressly incorporated herein by reference for their teachings in regard to that process. According to that process, the polyalkene and the maleic reactant are first reacted by heating them together in a "direct alkylation" procedure.

The amines which are reacted with the succinic acid-producing compounds to form the boron-free nitrogen-containing compositions may be monoamines and polyamines. The monoamines and/or polyamines must be characterized by the presence within their structure of at least one primary (i.e., $H_2N$—) or secondary (i.e., H—N=) amino group. The amines may be aliphatic, cycloaliphatic, aromatic, or heterocyclic. Moreover, the amines may be unsubstituted or aliphatic-substituted, cycloaliphatic substituted or aromatic-substituted. Also the amines may be saturated or unsaturated. The amines may also contain non-hydrocarbon substituents or groups as long as these groups do not significantly interfere with the reaction of the amines with the acylating reagents of this invention. Such non-hydrocarbon substituents or groups include lower alkoxy, lower alkyl mercapto, nitro, interrupting groups such as —O— and —S— (e.g., as in such groups as $—CH_2CH_2—X—CH_2CH_2$ where X is —O— or —S—).

In general, the amine of Component 1 may be characterized by the formula: $R_1R_2NH$, wherein $R_1$ and $R_2$ are each independently hydrogen or hydrocarbon, amino-substituted hydrocarbon, hydroxy-substituted hydrocarbon, alkoxy-substituted hydrocarbon, amino, carbamyl, thiocarbamyl, guanyl and acylimidoyl groups provided that only one of $R_1$ and $R_2$ may be hydrogen.

With the exception of the branched polyalkylene polyamine, the polyoxyalkylene polyamines, and the high molecular weight hydrocarbyl-substituted amines described more fully hereafter, the amines ordinarily contain less than about 40 carbon atoms in total and usually not more than about 20 carbon atoms in total.

Aliphatic monoamines include mono-aliphatic and di-aliphatic substituted amines wherein the aliphatic groups can be saturated or unsaturated and straight or branched chain. Thus, they are primary or secondary aliphatic amines. Such amines include, for example, mono- and di-alkyl-substituted amines, mono-and dialkenyl-substituted amines, and amines having one N-alkenyl substituent and one N-alkyl substituent and the like. The total number of carbon atoms in these aliphatic monoamines will, as mentioned before, normally not exceed about 40 and usually not exceed about 20 carbon atoms. Specific examples of such monoamines include ethylamine, diethylamine, n-butylamine, di-n-butylamine, allylamine, isobutylamine, cocoamine, stearylamine, laurylamine, methyllaurylamine, oleylamine, N-methyl-octylamine, dodecylamine, octadecyl-amine, and the like.

Cycloaliphatic monoamines are those monoamines wherein there is one cycloaliphatic substituent attached directly to the amino nitrogen through a carbon atom in the cyclic ring structure.

Aromatic amines suitable include those monoamines wherein a carbon atom of the aromatic ring structure is attached directly to the amino nitrogen.

The polyamines from which the nitrogen-containing ashless dispersant is derived include principally alkylene amines conforming for the most part to the Formula I:

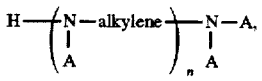

I wherein n is an integer preferably less than about 10, A is a hydrogen group or a substantially hydrocarbon group preferably having up to about 30 carbon atoms, and the alkylene group is a preferably a lower alkylene group having less than about 8 carbon atoms. The alkylene amines include principally methylene amines, ethylene amines, butylene amines, propylene amines, pentylene amines, hexylene amines, heptalene amines, octylene amines, other polymethylene amines. They are exemplified specifically by: ethylene diamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(trimethylene) triamine. Higher homologues such as are obtained by condensing two or more of the above-illustrated alkylene amines likewise are useful.

The nitrogen-containing composition obtained by reaction of the succinic acid-producing compounds and amines may be amine salts, amides, imides, imidazolines as well as mixtures thereof. To prepare the nitrogen-containing composition, one or more of the succinic acid-producing compounds and one or more of the amines are heated, optionally in the presence of a normally liquid, substantially inert organic liquid solvent/diluent at an elevated temperature generally in the range of from about 80° C. up to the decomposition point of the mixture or the product. Normally, temperatures in the range of about 100° C. up to about 300° C. are utilized provided that 300° C. does not exceed the decomposition point.

The succinic acid-producing compound and the amine are reacted in amounts sufficient to provide at least about one-half equivalent, per equivalent of acid-producing compound, of the amine. Generally, the maximum amount of amine present will be about 2 moles of amine per equivalent of succinic acid-producing compound. For the purposes of this invention, an equivalent of the amine is that amount of the amine corresponding to the total weight of amine divided by the total number of nitrogen atoms present.

A preferred boron-free nitrogen-containing ashless dispersant of the present invention is a mixture of Formula IIa and Formula IIb:

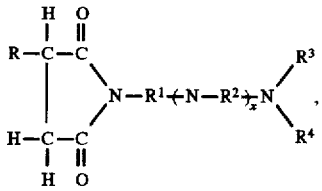

IIa

-continued

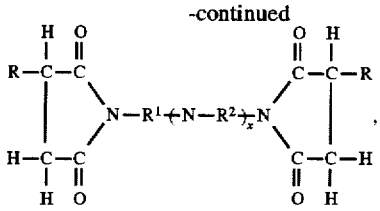

IIb wherein R is a $C_2$ to $C_{30}$ polyalkylene moiety, preferably polyethylene, polypropylene and polybutylene (especially polyisobutylene).

$R^1$ is an alkyl having 1 to 40 carbon atoms, preferably 1 to 10 carbon atoms, more preferably 1 to 5 carbon atoms, most preferably $R^1$ is $(CH_2)_n$, wherein n is an integer from 1 to 5, $R^2$ is an alkyl having 1 to 40 carbon atoms, preferably 1 to 10 carbon atoms, more preferably 1 to 5 carbon atoms, most preferably $R^2$ is $(CH_2)_m$, wherein m is an integer from 1 to 5, $R^3$ is selected from the group consisting of H and an alkyl having 1 to 40 carbon atoms, preferably H and an alkyl having 1 to 10 carbon atoms, $R^4$ is selected from the group consisting of H and an alkyl having 1 to 40 carbon atoms, preferably H and an alkyl having 1 to 10 carbon atoms, parameter X is an integer ranging from 0 to 12, preferably 2 to 8, more preferably 2 to 5, and there being an absence of a succinimide compound wherein a single nitrogen atom is bound to H and two carbonyl groups.

The preferred ashless dispersants are hydrocarbyl succinimides in which the hydrocarbyl substituent is a hydrogenated or unhydrogenated polyolefin group and preferably a polyisobutylene group having a number average molecular weight (as measured by gel permeation chromatography) of from 700 to 10,000, and more preferably from 700 to 5,000, more preferably from 750 to 2,500, and most preferably 950 to 1350.

An example of a preferred boron-free ashless dispersant is a mixture of polyisobutylene succinimide-polyethylenepolyamine of Formula IIIa and IIIb:

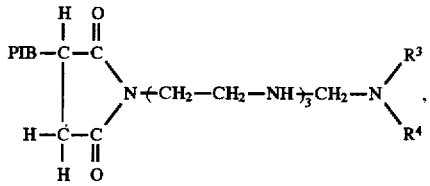

IIIa

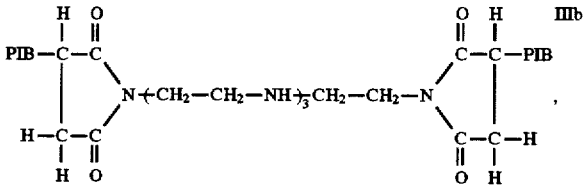

IIIb wherein PIB is polyisobutylene, $R^3$ is H and $R^4$ is H.

Component 2: Sulfur-Containing Agent

A wide variety of sulfur-containing extreme pressure or antiwear agents are available for use in the practice of this invention. Among suitable compositions for this use are included sulfurized animal or vegetable fats or oils, sulfurized animal or vegetable fatty acid esters, fully or partially esterified esters of trivalent or pentavalent acids of phosphorus, sulfurized olefins (see for example U.S. Pat. Nos. 2,995,569; 3,673,090; 3,703,504; 3,703,505; 3,796,661; 3,873,545; 4,119,549; 4,119,550; 4,147,640; 4,191,659; 4,240,958; 4,344,854; 4,472,306; and 4,711,736), dihydrocarbyl polysulfides (see for example U.S. Pat. Nos. 2,237,625; 2,237,627; 2,527,948; 2,695,316; 3,022,351; 3,308,166; 3,392,201; 4,564,709; and British 1,162,334), sulfurized Diels-Alder adducts (see for example U.S. Pat. Nos. 3,632,566; 3,498,915; and U.S. Pat. No. Re. 27,331), sulfurized dicyclopentadiene (see for example U.S. Pat. Nos. 3,882,031 and 4,188,297), sulfurized or co-sulfurized mixtures of fatty acid esters and monounsaturated olefin (see for example U.S. Pat. Nos. 4,149,982; 4,166,796; 4,166,797; 4,321,153; 4,481,140), co-sulfurized blends of fatty acid, fatty acid ester and α=olefin (see for example U.S. Pat. No. 3,953,347), functionally-substituted dihydrocarbyl polysulfides (see for example U.S. Pat. No. 4,218,332), thiaaldehydes, thia-ketones and derivatives thereof (e.g., acids, esters, imines, or lactones) (see for example, U.S. Pat. No. 4,800,031; and PCT International Application Publication No. WO 88/03552), epithio compounds (see for example, U.S. Pat. No. 4,217,233), sulfur-containing acetal derivatives (see for example U.S. Pat. No. 4,248,723), co-sulfurized blends of terpene and acyclic olefins (see for example U.S. Pat. No. 4,584,113), and polysulfide olefin products (see for example U.S. Pat. No. 4,795,576).

Preferred materials useful as component (i) are sulfur-containing organic compounds in which the sulfur-containing species are bound directly to carbon or to more sulfur.

One particularly preferred class of such agents is made by reacting an olefin, such as isobutene, with sulfur. The product, e.g., sulfurized isobutene, preferably sulfurized polyisobutylene, typically has a sulfur content of 10 to 50%, preferably 30 to 50% by weight. A wide variety of other olefins or unsaturated hydrocarbons, e.g., isobutene dimer or trimer, may be used to form such agents.

Another particularly preferred class of such agents is that of polysulfides composed of one or more compounds represented by the formula: $R^6—S_x—R^7$ where $R^6$ and $R^7$ are hydrocarbyl groups each of which preferably contains 3 to 18 carbon atoms and x is preferably in the range of from 2 to 8, and more preferably in the range of from 2 to 5, especially 3. The hydrocarbyl groups can be of widely varying types such as alkyl, cycloalkyl, alkenyl, aryl, or aralkyl. Tertiary alkyl polysulfides such as di-tert-butyl trisulfide, and mixtures comprising di-tert-butyl trisulfide (e.g., a mixture composed principally or entirely of the tri, tetra-, and pentasulfides) are preferred. Examples of other useful dihydrocarbyl polysulfides include the diamyl polysulfides, the dinonyl polysulfides, the didodecyl polysulfides, and the dibenzyl polysulfides.

Component 3: Phosphorus-Containing Agents

Component 3 is composed of one or more oil-soluble amine salts of one or more partial esters of one or more acids of phosphorus, preferably one or more partial esters of one or more acids of pentavalent phosphorus. Such compounds may be represented by the Formulas IV, V and VI:

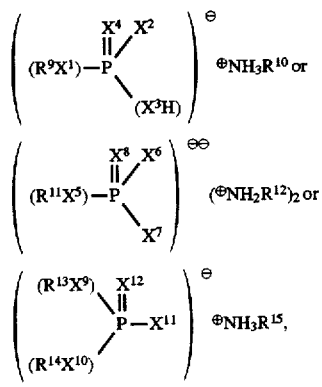

IV

V

VI or mixtures thereof. In Formulas IV, V and VI, each of $R^9$–$R^{15}$ is, independently, a hydrocarbyl group and each of $X^1$–$X^{12}$ is independently, an oxygen atom or a sulfur atom.

Useful salts or adducts can be made of the one or more acids of pentavalent phosphorous and an amine selected from the group consisting of octylamine, nonylamine, decylamine, undecylamine, dodecylamine, tridecylamine, tetradecylamine, pentadecylamine, hexadecylamine, heptadecylamine, octadecylamine, cyclohexylamine, phenylamine, mesitylamine, oleylamine, cocoamine, soyamine, $C_{10-12}$ tertiary alkyl primary amines, and phenethylamine and mixtures of any such compounds. Secondary hydrocarbyl amines and tertiary hydrocarbyl amines can also be used either alone or in combination with each other or in combination with primary amines. Thus, any combination of primary, secondary and/or tertiary amines, whether monoamine or polyamine, can be used in forming the salts or adducts. Use of primary amines is preferred. It is perhaps worth noting that the above referred to partially esterified pentavalent acids of phosphorus have been named, for convenience, by use of the "thio-thiono" system of nomenclature. Such compounds can also be named by use of a "thioic" system of nomenclature. For example, S,S-dihydrocarbylphosphorotetrathioic acid, $(RS)_2P(S)(SH)$. Likewise, O,S-dihydrocarbylthiophosphoric acid is also known as O,S-dihydrocarbyl-phosphorodithioic acid, (RO)(RS)P(S)(OH); S,S-dihydrocarbyldithiophosphoric acid is also known as S,S-dihydrocarbylphosphorodithioic acid, $(RS)_2P(O)(OH)$; and O,O-dihydrocarbylthionophosphoric acid is also known as O,O-dihydrocarbylphosphorothioic acid, $(RO)_2P(S)(OH)$.

Methods for the preparation of such amine salts are well known and reported in the literature. See for example, U.S. Pat. Nos. 2,063,629; 2,224,695; 2,447,288; 2,616,905; 3,984,448; 4,431,552; Pesin et al. *Zhurnal Obshchei Khimii*, Vol. 31, No. 8, pp. 2508–2515 (1961); and PCT International Application Publication No. WO 87/07638.

A typical version of component 3 consists of an approximately 80:20 to 20:80, preferably, approximately 50:50 mixture of compounds of the following two formulas VII and VIII where $R^{17}$ is a hydrocarbyl group with 4–10 carbon atoms and $R^{18}$ is a hydrocarbyl group of 8–22 carbon atoms:

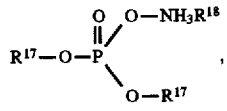

VII

-continued

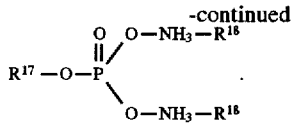

VIII

In a typical phosphorus-containing agent, $R^{17}$ is a hydrocarbyl group of about 5 carbons (amyl acid phosphate), a hydrocarbyl group of about 8 carbons (2-ethyl hexyl acid phosphate), or octyl acid phosphate.

A typical $R^{18}$ is a mixture of $C_{18}$ mono-unsaturated and $C_{11}$–$C_{14}$ branched hydrocarbyl groups. A typical ratio in the mixture is 10–50% $C_{18}$ and 50–90% $C_{11}$–$C_{14}$ ingredients, preferably 20–30% $C_{18}$ and 70–80% $C_{11}$–$C_{14}$ ingredients, more preferably 25–30% $C_{18}$ and 70–75% $C_{11}$–$C_{14}$. Examples of such amines include oleylamine (9-octadecen-1-amine) and $C_{11}$–$C_{14}$ tertiary alkyl primary amine. Another typical amine is n-octylamine. The $C_{11}$–$C_{14}$ amine may be used alone, although the mixture achieves a better balance of wear and oxidation properties.

A typical reaction includes a mixture of approximately 50/50 di to mono-substituted, acid phosphate (dialkyl-and mono-alkyl phosphoric acids) of Formula IX:

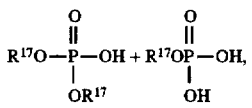

IX reacted with amines of Formula X:

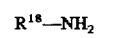

X.

The above reacts to form the phosphorus-containing agent which includes the mixture of compounds of Formula XI:

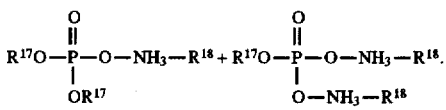

XI

Diluents

The additive concentrates of this invention preferably contain a suitable diluent, most preferably an oleaginous diluent of suitable viscosity. Such diluent can be derived from natural or synthetic sources. Among the mineral (hydrocarbonaceous) oils are paraffin base, naphthenic base, asphaltic base and mixed base oils. Typical synthetic base oils include polyolefin oils (especially hydrogenated α-olefin oligomers), alkylated aromatic, polyalkylene oxides, aromatic ethers, and carboxylate esters (especially diester oils), among others. Blends of natural and synthetic oils can also be used. The preferred diluents are the light hydrocarbon base oils, both natural or synthetic. Generally the diluent oil will have a viscosity in the range of 13 to 35 centistokes at 40° C., and preferably in the range of 18.5 to 21.5 centistokes at 40° C. A 100 neutral mineral oil with a viscosity of about 19 centistokes at 40° C. with a specific gravity (ASTM D 1298) in the range of 0.855 or 0.893 (most preferably about 0.879) at 15.6° C. (60° F.) and an ASTM color (D 1500) of 2 maximum or a 45 neutral hydrotreated mineral oil with a 40° C. kinematic viscosity of about 4.5 centistokes, a specific gravity in the range of 0.85 to 0.88, and an ASTM color of 2 maximum are particularly preferred for this use.

Gear Oil Base Stocks

The gear oils in which the compositions of this invention are employed can be based on natural or synthetic oils, or blends thereof, provided the lubricant has a suitable viscosity for use in gear oil applications. Thus, the base oils will normally have a viscosity in the range of SAE 50 to SAE 250, and more usually will range from SAE 70W to SAE 140. Suitable automotive gear oils also include cross-grades such as 75W-140, 80W-90, 85W-140, 85W-90, and the like. The base oils for such use are generally mineral oil base stocks such as, for example, conventional and solvent-refined paraffinic neutrals and bright stocks, hydrotreated paraffinic neutrals and bright stocks, naphthenic oils, or cylinder oils, including straight run and blended oils. Synthetic base stocks can also be used in the practice of this invention, such as for example poly-α-olefin oils (PAO), alkylated aromatics, polybutenes, diesters, polyol esters, polyglycols, or polyphenyl ethers, and blends thereof. Typical of such oils are blends of poly-alpha-olefins with synthetic diesters in weight proportions (PAO:ester) ranging from 95:5 to 50:50, typically 75:25. Some base stocks work better than others towards meeting L-60-1 standards. For example, hydrotreated base stocks and synthetic base stocks are preferred.

Proportions

In forming the gear oils of this invention, the lubricant base stocks will usually contain above-described components 1, 2 and 3 in the following concentrations (weight percentages of active ingredients in the gear oils of this invention):

TABLE 1

| Components | Preferred Range | More Preferred Range | Most Preferred Range |
|---|---|---|---|
| (1) Ashless Dispersant | 0.3–3.0 | 0.6–2 | 0.7–1.4 |
| (2) Sulfur-containing Agent | 1–5.25 | 1.5–4.5 | 2–4 |
| (3) Phosphorous-containing Agent | 0.1–3 | 0.2–2 | 0.3–1.2 |

Optionally, other components, e.g., diluents, defoamers, etc., which follow are also present in the gear oil. However, the preferred compositions of this invention are essentially devoid of metal-containing components.

The composition of the present invention may be used as an additive concentrate. In the additive concentrates containing a diluent such as an oleaginous liquid, the total content of the concentrate in the oleaginous liquid should normally fall within the range of 1 to 13%, preferably 1.5 to 10% and most preferably 2 to 9% based on the total weight of the concentrate (including other ancillary components, if used).

The weight ratios of components (1), (2) and (3) in the additive concentrates of this invention will be at levels which will allow the ranges of TABLE 1 to be met when the concentrate is used at its proper dosage in oleaginous liquid. Other components, such as described below, can also be included in such additive concentrates.

Other Components

The gear oils and gear oil additive concentrates of this invention can contain various other conventional additives to partake of their attendant functions. These include, for example, the following materials:

Defoamers—Illustrative materials of this type include silicone oils of suitable viscosity, glycerol monostearate, polyglycol palmitate, trialkyl monothiophosphates, esters of sulfonated ricinoleic acid, benzoylacetone, methyl salicylate, glycerol monooleate, glycerol dioleate, and the like. Defoamers are generally employed at concentrations of up to about 1% in the additive concentrate.

Demulsifiers—Typical additives which may be employed as demulsifiers in gear oils include alkyl benzene sulfonates, polyethylene oxides, polypropylene oxides, esters of oil soluble acids and the like. Such additives are generally employed at concentrations of up to about 3% in the additive concentrate.

Sulfur Scavengers—This class of additives includes such materials as thiadizoles, triazoles, and in general, compounds containing moieties reactive to free sulfur under elevated temperature conditions. See, for example, U.S. Pat. Nos. 3,663,561 and 4,097,387. Concentrations of up to about 3% in the concentrate are typical.

Antioxidants—Ordinarily, antioxidants that may be employed in gear oil formulations include phenolic compounds, amines, phosphites, and the like. Amounts of up to about 5% in the concentrate are generally sufficient. Other commonly used additives or components include anti-rust agents or rust inhibitors, corrosion inhibitors, detergents, dyes, metal deactivators, pour point depressants, and diluents.

Thus, the present invention covers compositions of boron-free ashless dispersant of type described as component 1, with a sulfur-containing agent described as Component 2, and a phosphorus containing agent described as Component 3 along with other optional components to produce an additive which, when blended in a suitable base oil (described in gear oil base stocks), can meet MT-1 and MIL-PRF-2105E requirements. MT-1 and MIL-PRF-2105E are requirements for a clean gear manual transmission oil (MT-1) and rear axle oil (MIL-PRF-2105E). Additives for this type of clean gear application have normally been formulated with boronated dispersant.

Benefits of using a boron-free dispersant include:

1. lower cost due to not having to add boron or do additional processing to attach the boron to the dispersant; and
2. no precipitation from boron which detaches from the dispersant;

The MIL PRF-2105E Standard

The MIL-PRF-2105E standard (Aug. 22, 1995) includes a large number of tests which must be passed. The MIL-PRF-2105E standard is published by the U.S. Army Tank Automotive and Armaments Command, Department of the Army, and is herein incorporated by reference in its entirety. The gear lubricating oils are of the following grades: 75W, 80W-90 and 85W-140.

To meet MIL-PRF-2105E, the gear oil has the properties specified by TABLE 2.

TABLE 2

| Property[1] | Grade 75W | Grade 80W-90 | Grade 85W-140 |
|---|---|---|---|
| Viscosity Kinematic, cSt, | | | |
| @ 100° C. Min. | 4.1 | 13.5 | 24.0 |
| Max. | — | <24.0 | <41.0 |
| @ 40° C.[2] | — | — | — |
| Apparent Viscosity cP, 150,000 max. @ °C., temp. | −40 | −26 | −12 |

TABLE 2-continued

| Property[1] | Grade 75W | Grade 80W-90 | Grade 85W-140 |
|---|---|---|---|
| Channel Point, °C., max | −45 | −35 | −20 |
| Flash Point, °C., min | 150 | 165 | 130 |

[1]Values shall be reported for all requirements
[2]Set by user

The gear oil also meets the following criteria listed in TABLE 3.

TABLE 3

| Test | ASTM Test Method[9] | FED-STD-791 Method No. |
|---|---|---|
| Viscosity, kinematic | D 455 | |
| Viscosity apparent | D 2983 | |
| Viscosity index | D 2270 | |
| Channel point | | 3456 |
| Flash point | D 92 | |
| Gravity, API | D 287 | |
| Pour point | D 97 | |
| Pentane insolubles | D 893 | |
| Carbon residue | D 524 | |
| Color | D 1500 | |
| Total acid number | D 664 | |
| Saponification number | D 94 | |
| Boiling range distribution | D 2887 | |
| Sulfur[3] | D 1552, D 2622, D 129, D 4294, D 4927, D 4951, D 5185 | |
| Phosphorus[4] | D 1091, D 4047, D 4927, D 4951, D 5185 | |
| Chlorine[5] | D 808, D 1317 | |
| Nitrogen | D 3228, D 4629 | |
| Metallic Components | D 4628, D 4927, D 4951, D 5185 | |
| Foaming | D 892 | |
| Storage Stability | | 3440 |
| Compatibility[6] | | 3430 |
| Copper Corrosion | D 130 | |
| Moisture Corrosion[7] | L-33 | |
| Thermal and Oxidative Stability | L-60-1(D-5704) | |
| Load-carrying, extreme-pressure and deposition characteristics | | |
| Gear Scoring[7,8] | L-42 | |
| Gear Distress and deposits[7] | L-37 | |
| Cyclic Durability | D-5579 | |
| Elastomer Compatibility | D-5662 | |

[3]D 1552 is the preferred method. D 4294 is only for use with base stocks.
[4]D 1091 is the preferred method.
[5]D 808 is the preferred method but D 1317 may be used as alternate.
[6]See Compatibility Parameter.
[7]In accordance with ASTM STP 512A.
[8]See Gear Scoring parameter.
[9]Copies for all ASTM test methods should be addressed to the American Society for Testing and Materials, 1916 Race Street, Philadelphia, Pennsylvania 19103, U.S.A.

Channel Point

The gear oil is non-channeling at the temperature indicated by TABLE 2 when tested in accordance with TABLE 3 (Method 3456 FED-STD-791).

Foaming

The oil has the following foaming characteristics when tested according to the test method listed on TABLE 4 (ASTM D 892).

a. In the initial test at 24°±0.5° C. Not more than 20 mL of foam shall remain immediately following the 5-minute blowing period.

b. Intermediate test at 93.5°±0.5° C. Not more than 50 mL of foam shall remain immediately following the 5-minute blowing period.

c. Final test at 24°±0.5° C. Not more than 20 mL of foam shall remain immediately following the 5-minute blowing period.

Storage Stability

The gear oil shall demonstrate the characteristics for separated solid material, liquid material, or a combination of the two materials when tested in accordance with TABLE 3 (Method 3440, FED-STD-791). When the separated material is solid, the average increase in the weight of each centrifuge tube and residue over the initial weight of the clean tube shall not exceed 0.25 mass percent of the additive material originally contained in the sample. When the separated material is liquid, it shall not exceed 0.50 volume percent of the additive material originally contained in the sample.

Compatibility

The gear oil shall be compatible with other gear lubricants qualified under MIL-PRF-2105E in accordance with TABLE 3 (method 3430, FED-STD-791). Typically, the test is performed by subjecting separate mixtures of the oil with six selected reference oils.

Moisture Corrosion

The oil shall prevent or minimize corrosion to gear unit components in the presence of moisture. Satisfactory performance shall be demonstrated when the oil is tested in accordance with TABLE 3 (ASTM STP 512A, L-33 Test) and exhibits test results of one percent or less rust on a test cover plate and no rust on gear teeth, bearings and functional components.

Thermal and Oxidative Stability

The oil shall resist thermal and chemical oxidation. Satisfactory performance shall be demonstrated when the oil is tested in accordance with TABLE 3 (ASTM D-5704, L-60-1 Test) for 50 hours and meets the criteria of TABLE 4:

TABLE 4

| Parameters | Limits |
|---|---|
| Kinematic Viscosity Increase %, @ 100° C., cSt | 100 max |
| N-Pentane Insolubles, wt % | 3.0 max |
| Toluene Insolubles, wt % | 2.0 max |
| Carbon Varnish Rating | 7.5 min |
| Sludge Rating | 9.4 min |

If more than one test is conducted, then the average of two test results must meet the above limits. No more than three tests are allowed. When three tests are conducted, one of the three can be discarded and the average of the remaining two tests must meet the above limits. Typically, the oil has from about 0 to about 3.0 weight percent n-pentane insolubles, about 0 to about 2.0 weight percent toluene insolubles, a carbon/varnish rating of about 7.5 to about 10, and a sludge rating of about 9.4 to about 10. The limits are set by the military for MIL-PRF-2105E approval.

Load-carrying Extreme-pressure and Deposition Characteristics

The oil shall prevent or minimize gear distress and lubricant deposits under conditions of high-speed and shock-loading and conditions of high-speed, low-torque and low-speed, high-torque operation.

Gear Scoring

Satisfactory performance shall be demonstrated when the oil is tested in duplicate in accordance with TABLE 3 (ASTM STP 512A, L-42 Test) and exhibits scoring less than or equal to ASTM Reference Oil RGO 114, or most recent blend approved by ASTM under conditions of high-speed and shock-loading.

For grade 75W oil, the L-42 gear scoring test shall be modified such that the sequence II (high-speed) portion of the test shall be commenced at a temperature of 79° C. and sequence IV (shock-loading) run with water sprays on commencing at 93° C. with a maximum rise of 5.5° to 8.3° C.

Gear Distress and Deposits

Satisfactory performance shall be demonstrated when the oil is tested in accordance with TABLE 3 (ASTM STP 512A, L-37 Test) using untreated and phosphate-treated gear assemblies and prevents gear-tooth ridging, rippling, pitting, welding, spalling, and excessive wear or other surface distress and objectionable deposits and does not produce excessive wear, pitting or corrosion of bearing rollers, or races under conditions low-speed, high-torque.

Copper Corrosion

The oil shall minimize copper corrosion. Satisfactory performance shall be demonstrated when the oil is tested in accordance with TABLE 3 (ASTM D 130) for 3 hours at 121°±1° C. and exhibits copper strip discoloration not exceeding ASTM No. 2 when compared to the ASTM Copper Strip Corrosion Standard.

Cyclic Durability

Satisfactory performance shall be demonstrated when the oil is tested in accordance with TABLE 3 (ASTM D-5579). The test evaluates the thermal stability of gear lubricants when subjected to cyclic operating conditions of high-low range and high temperature. The oil shall avoid deteriorating the synchronizer performance by preventing two unsynchronized shifts from occurring at cycles equal to or lower than the mean of the prior five passing reference oil results in the same test stand.

Elastomer Compatibility

The gear lubricants shall minimize deterioration of elastomer materials. Satisfactory performance shall be demonstrated when the oils are tested and rated in accordance with TABLE 3 (ASTM D-5662) and exhibits test results meeting the nominal criteria of TABLE 5 as adjusted to accommodate slight changes in individual elastomer batches:

TABLE 5

| Parameters | Minimum | Maximum |
|---|---|---|
| Polyacrylate @ 150° C., 240 hrs: | | |
| Elongation Change, % | — | −60 |
| Hardness Change, points | −25 | +5.0 |
| Volume Change, % | −5 | +30 |
| Fluoroelastomer @ 150° C., 240 hrs: | | |
| Elongation Change, % | — | −75 |
| Hardness Change, points | −5 | +10 |
| Volume Change, % | −5 | +15 |

The MT-1 and GL-5 Standards

The gear lubricants disclosed by this specification meet American Petroleum Institute (API) Service Classifications MT-1 and GL-5 and are intended for automotive gear units, heavy-duty industrial type enclosed gear units, steering gear units, heavy-duty non-synchronized type 7 & 8 manual transmission, and fluid lubricated universal joints of automotive equipment.

MT-1 has the following requirements as listed in TABLE 6.

TABLE 6

| | Minimum | Maximum |
|---|---|---|
| ASTM D-5704 L-60-1 Thermal Stability & Cleanliness | | |
| % Viscosity Increase | — | 100% |
| % Pentane Insolubles | — | 3.0% |
| % Toluene Insolubles | — | 2.0% |
| Carbon/Varnish Rating (Large Gear) | 7.5 | — |
| Sludge Rating (Average of 4 faces) | 9.4 | — |
| ASTM D-5662 Gear Oil Compatibility with Seal Materials Polyacrylate @ 150° C. | | |
| Elongation, % | −60 | none |
| Hardness Points | −20 | +5.0 |
| Volume Change, % | −5 | +30 |
| Fluoroelastomer @ 150° C. | | |
| Elongation, % | −75 | none |
| Hardness Points | −5 | +10 |
| Volume Change, % | −5 | +15 |
| ASTM D-5579 Evaluating Cyclic Durability of oils in Manual Transmission Shift Sequence | Greater than the average of the last 5 passing references | — |
| Test Method ASTM D 130 for Copper Corrosion Protection | — | 2 |
| Test Method ASTM D 1582 for Evaluation of Scuffing Resistance (FZG) | Load Stage 10 Pass | — |
| Test Method ASTM D 892 for Determining Lubricant Foam Tendency | | |
| Sequence I, ml | — | 20 ml |
| Sequence II, ml | — | 50 ml |
| Sequence III, ml | — | 20 ml |
| FTM 3440 Test Method for Gear Lubricant Compatibility Characteristics | Compatible with MIL-L-2105D Oils | |
| Test Method FTM 3430 Storage Solubility Characteristics of Universal Gear Lubricants | | Separated Solid Material 0.25%/mass 0.50%/volume max. |

[10]Standard set by ASTM.

The tests for L-60-1 carbon varnish and sludge rating involve employing the lubricating oil to lubricate a large gear and a small gear which mesh with each other in a test apparatus. A carbon/varnish measurement and a sludge measurement is made for the large gear front face, large gear rear face, small gear front face and small gear rear face. The carbon varnish rating is the average of the carbon varnish measurements of the large gear front face and large gear rear face. The sludge rating is the average of the sludge measurements at all four faces.

GL-5 has the specification listed in TABLE 7.

TABLE 7

PERFORMANCE REQUIREMENTS FOR MIL-L-2105D (GL-5) LUBRICANTS (AUGUST 1987)

| SAE VISCOSITY GRADE | | 75W | 80W90 | 85W140 |
|---|---|---|---|---|
| CRC L-60 | | | | |
| Thermal Oxidation Stability | 100° C. visc. Increase @ 50 hrs., Max. % | 100 | 100 | 100 |
| | Pentane Insolubles, % | 3 | 3 | 3 |
| | Toluene Insolubles, % | 2 | 2 | 2 |
| CRC L-33, | | | | |
| 7 Day Moisture | Rust on gear Teeth Bearings, Max. % | 0 | 0 | 0 |

TABLE 7-continued

PERFORMANCE REQUIREMENTS FOR MIL-L-2105D (GL-5) LUBRICANTS (AUGUST 1987)

| SAE VISCOSITY GRADE | | 75W | 80W90 | 85W140 |
|---|---|---|---|---|
| Corrosion | Rust on Coverplate, Max. % | 1 | 1 | 1 |
| CRC L-37 | | | | |
| High Speed-Low Torque | "Green" Gears | Pass | Pass | NR |
| High Torque-Low Speed | "Lubrited" Gears | Pass | Pass | NR |
| CRC L-42 | | | | |
| High Speed-Shock Loading Axle Test | Ring & Pinion Tooth Scoring, Max. % | Equal to or better than RGO 110-90 | | NR |
| ASTM D-130 | | | | |
| Copper Strip Corrosion | Strip Rating, Max. | 3 | 3 | 3 |

Notes:
NR - Not required, if 80W90 passes in the same base stock Lower L-37 and L-42 Test Temperatures are required for 75W oils The present invention is further illustrated by the following non-limiting examples.

EXAMPLES

The following ingredients were employed to make compositions that were tested according to L-60-1 Carbon/Varnish Ratings and L-60-1 Sludge Ratings. These L-60-1 tests are standardized tests by ASTM. The L-60-1 procedure is included in ASTM Special Technical Publication STP 512A, "Laboratory Performance Tests Intended for API GL-5 Service" incorporated herein by reference.

The following TABLES 8–13 present the compositions of the tested additive concentrates and present the test results. In all the Examples of the present specification, the amounts of ingredients in the additive concentrates are presented as weight percents on a base oil-free basis. The type of base oil is also listed in the appropriate table unless otherwise stated. The presence of the base oil is indicated by an "X" in the TABLES unless otherwise stated.

The base oils employed are Mineral Oil A, Mineral Oil B, Mineral Oil C or Mineral Oil D. A. Mineral Oil A is an 80W-90 base oil which is a blend of two solvent refined base stocks (Pennzoil 150 Bright and Pennzoil 140 Neutral) with a small (less than 2 wt. %) amount of pour point depressant added. Mineral Oil B is an 85W-140 base oil which is a blend of two solvent refined base stocks (Pennzoil 150 Bright and Pennzoil 140 Neutral) with a small (less than 2 wt. %) amount of pour point depressant added. The pour point depressant used in Mineral Oils A and B is a solution of acrylic polymer in a severely refined mineral oil. Mineral Oil C is an 80W-90 base oil which is a blend of three solvent refined base stocks (Exxon 150 Bright, Exxon 600 Neutral and Exxon 150 Neutral) with a small (less than 2 wt. %) amount of HiTEC 672 (Ethyl Corporation) pour point depressant added. Mineral Oil D is an 85W-140 base oil which is also a blend of three solvent refined base stocks (Exxon 150 Bright, Exxon 600 Neutral and Exxon 150 Neutral) with a small (less than 2 wt. %) amount of HiTEC 672 (Ethyl Corporation) pour point depressant added.

The concentrates are generally present in an amount of about 7.50% of the total weight of base oil and concentrate unless otherwise stated. In all the TABLES for the Examples of the present specification, like numbered footnotes indicate like ingredients or parameters.

Examples 1–6

Examples 1–6 of TABLE 8 show the effects of increasing dispersant and the effect of employing different molecular weight dispersants. In these Examples, the concentrates are present at a concentration of 7 weight percent in 85W-140 Mineral Oil B.

TABLE 8

| | Example Nos. | | | | | |
|---|---|---|---|---|---|---|
| | 1 | 2 | 3 | 4 | 5 | 6 |
| SIB[1] | 47.14 | 47.14 | 47.14 | 47.14 | 47.14 | 47.14 |
| C11-14 amine[2] | 4.34 | 4.34 | 4.34 | 4.34 | 4.34 | 4.34 |
| Oleylamine[3] | 2.14 | 2.14 | 2.14 | 2.14 | 2.14 | 2.14 |
| Amyl Acid Phosphate[4] | 6.36 | 6.36 | 6.36 | 6.36 | 6.36 | 6.36 |
| HiTEC 4313[5] | 0.64 | 0.64 | 0.64 | 0.64 | 0.64 | 0.64 |
| Defoamer[6] | 0.54 | 0.54 | 0.54 | 0.54 | 0.54 | 0.54 |
| Demulsifier[7] | 0.16 | 0.16 | 0.16 | 0.16 | 0.16 | 0.16 |
| Unboronated Succinimide A[8] | 21.43 | 18.75 | 16.07 | | 21.43 | 18.75 |
| Unboronated Succinimide B[9] | | | | 21.43 | | |
| Process Oil #5[10] | 17.25 | 19.92 | 22.60 | 17.25 | 17.25 | 19.92 |

TABLE 8-continued

| | Example Nos. | | | | | |
|---|---|---|---|---|---|---|
| | 1 | 2 | 3 | 4 | 5 | 6 |
| Carbon/Varnish Rating[11] | 8.40 | 8.90 | 7.50 | 8.50 | 8.95 | 9.15 |
| Sludge Rating[12] | 9.41 | 9.50 | 9.41 | 9.36 | 9.48 | 9.40 |
| % Viscosity Increase[13] | 76.00 | 163.40 | 67.10 | 64.70 | 111.90 | 110.10 |
| Pentane Insolubles[14] | 1.82 | 4.69 | 1.89 | 2.00 | 3.50 | 3.24 |
| Toluene Insolubles[15] | 0.84 | 0.20 | 0.12 | 0.87 | 0.31 | 1.42 |
| TAN[16] | 6.00 | 7.70 | 7.40 | 7.80 | 6.90 | 8.10 |
| % Cu wt. loss[17] | 11.00 | 7.90 | 11.00 | 11.20 | 10.97 | 10.00 |

Notes:
[1]Sulfurized polyisobutylene having a number average molecular weight of about 310
[2]C11-C14 tertiary alkyl primary amine mixture, reacts with the phosphorous source (amyl acid phosphate) to form an antiwear agent
[3]Amine, reacts with the phosphorous source (amyl acid phosphate) to form an antiwear agent
[4]Amyl acid phosphate (AAP), reacts with the C11-14 amine and oleylamine to form a salt
[5]HiTEC 4313 ashless alkyl thiadiazole, a product of Ethyl Corporation, Richmond, Virginia, used as a copper corrosion inhibitor
[6]Alkyl polymethyacrylate used as a defoamer.
[7]Block copolymer of ethylene oxide and propylene oxide having a weight average molecular weight of 2000. Employed as a demulsifier.
[8]Unboronated 1300 MW polybutenyl succinimide, produced from acylating polyisobutylene with maleic anhydride and reacting the acylated hydrocarbon with polyethylene amines.
[9]Unboronated 900 MW polybutenyl succinimide, produced from acylating polyisobutylene with maleic anhydride and reacting the acylated hydrocarbon with polyethylene amines.
[10]100 Neutral mineral oil (approximately 100 SUS at 100° F.)
[11]L-60-1 Carbon/Varnish Rating
[12]L-60-1 Sludge Rating
[13]L-60-1 Viscosity Increase
[14]L-60-1 Pentane Insolubles
[15]L-60-1 Toluene Insolubles
[16]Total acid number
[17]The percent copper weight loss was measured by comparing the copper in the oil before and after testing.

Examples 7–8

Examples 7–8 employ additives, at a total concentration of 7.5 weight percent in Mineral Oil B, 85W-140 base oil, and show the effects of increased unboronated Succinimide A and polyisobutylene as shown in TABLE 9.

TABLE 9

| | Example Nos. | |
|---|---|---|
| | 7 | 8 |
| SIB[1] | 48.000 | 48.000 |
| C11-14 amine[2] | 3.7000 | 3.700 |
| Oleylamine[3] | 2.000 | 2.000 |
| Amyl Acid Phosphate[4] | 5.963 | 5.963 |
| Demulsifier[7] | 0.150 | 0.150 |
| HiTEC 4313[5] | 1.000 | 1.000 |
| Defoamer[6] | 0.500 | 0.500 |
| Unboronated Succinimide A[8] | 20.000 | 24.000 |
| Process Oil #5[10] | 18.687 | 14.687 |
| Carbon/Varnish Rating[11] | 8.80 | 8.75 |
| Sludge Rating[12] | 9.44 | 9.38 |
| % Viscosity Increase[13] | 140.64 | 71.91 |
| Pentane Insolubles[14] | 3.64 | 3.43 |
| Toluene Insolubles[15] | 0.40 | 0.27 |
| % Cu wt. loss[17] | 11.63 | 12.27 |

Notes:
See TABLE 8

These tests show the results of increased levels of Unboronated Succinimide-A on L-60-1 performance. All Carbon/Varnish ratings were passes. The sludge ratings on both tests were acceptable.

Examples 9–14

Examples 9–14 of TABLES 10 and 11 demonstrate the effectiveness of the present invention having the total additive at a concentration of 7.5 weight percent with various base oils.

TABLE 10

| | Example Nos. | | | |
|---|---|---|---|---|
| | 9 | 10 | 11 | 12 |
| SIB[1] | 47.000 | 47.000 | 47.000 | 47.000 |
| C11-14 amine[2] | 4.050 | 4.050 | 4.050 | 4.050 |
| Oleylamine[3] | 2.000 | 2.000 | 2.000 | 2.000 |
| Amyl Acid Phosphate[4] | 5.936 | 5.936 | 5.936 | 5.936 |
| HiTEC 4313[5] | 0.600 | 0.600 | 0.600 | 0.600 |
| Defoamer[6] | 0.500 | 0.500 | 0.500 | 0.500 |
| Demulsifier[7] | 0.150 | 0.150 | 0.150 | 0.150 |
| Unboronated Succinimide A[8] | 17.500 | 17.500 | 17.500 | 17.500 |
| Process Oil[18] | 19.264 | 19.264 | 19.264 | 19.264 |
| Process Oil #5[10] | 3.000 | 3.000 | 3.000 | 3.000 |
| 80W-90 Mineral Oil A | X | X | | |
| 85W-140 Mineral Oil B | | | X | X |
| Carbon/Varnish Rating[11] | 8.91 | 8.40 | 8.45 | 8.90 |
| Sludge Rating[12] | 9.43 | 9.46 | 9.40 | 9.47 |
| % Viscosity Increase[13] | 66.05 | 59.71 | 94.86 | 96.19 |
| Pentane Insolubles[14] | 3.22 | 2.33 | 3.53 | 2.28 |
| Toluene Insolubles[15] | 2.90 | 2.01 | 1.03 | 0.69 |
| TAN[16] | 10.20 | 6.80 | 9.50 | 7.10 |
| % Cu wt. loss[17] | 9.38 | 11.34 | 9.08 | 9.91 |

Notes:
See TABLE 8

TABLE 11

| | Example Nos. | |
|---|---|---|
| | 13 | 14 |
| SIB[1] | 47.000 | 47.000 |
| C11-14 amine[2] | 4.050 | 4.050 |
| Oleylamine[3] | 2.000 | 2.000 |
| Amyl Acid Phosphate[4] | 5.936 | 5.936 |
| HiTEC 4313[5] | 0.600 | 0.600 |
| Defoamer[6] | 0.500 | 0.500 |
| Demulsifier[7] | 0.150 | 0.150 |
| Unboronated Succinimide A[8] | 17.500 | 17.500 |
| Process Oil[18] | 19.264 | 19.264 |
| Process Oil #5[10] | 3.000 | 3.000 |
| 80W-90 Mineral Oil C | X | |
| 85W-140 Mineral Oil D | | X |
| Carbon/Varnish Rating[11] | 8.75 | 8.80 |
| Sludge Rating[12] | 9.47 | 9.44 |
| % Viscosity Increase[13] | 46.27 | 47.50 |
| Pentane Insolubles[14] | 0.36 | 0.12 |
| Toluene Insolubles[15] | 0.31 | 0.13 |
| TAN[16] | 9.60 | 6.00 |
| % Cu wt. loss[17] | 12.40 | 11.27 |

The data of Tables 10 and 11 demonstrates the passing (by MIL-PRF-2105E and MT-1 standards) L-60-1 sludge and carbon/varnish performance of a clean gear additive which uses unboronated Succinimide A, when the additive is blended in several base stocks and viscosity grades.

Examples 15–16

Examples 15–16 of TABLE 12 employ oil treated with 7.5 wt % additive.

TABLE 12

| | Example Nos. | |
|---|---|---|
| | 15 | 16 |
| H-313[21] | 40.000 | 40.000 |
| C11-14 amine[2] | 4.850 | 4.850 |
| oleylamine[3] | 2.000 | 2.000 |
| AAP[4] | 7.000 | 7.000 |
| Octanoic Acid | 0.300 | 0.300 |
| HiTEC 4313[5] | 0.800 | 0.800 |
| Defoamer[6] | 0.500 | 0.500 |
| Unboronated Succinimide A[8] | 10.000 | 20.000 |
| Boronated Succinimide[22] | 10.000 | |
| Process Oil #5[10] | 24.550 | 24.550 |
| 80W-90 Mineral Oil C | X | X |
| Viscosity Increase[13] | 42.77 | 57.71 |
| Pentane Insolubles[14] | 0.19 | 0.17 |
| Toluene Insolubles[15] | 0.09 | 0.06 |
| TAN[16] | 4.62 | 4.87 |
| Carbon/Varnish[11] | 8.80 | 8.70 |
| Sludge Rating[12] | 9.56 | 9.50 |
| % Cu Weight Loss[17] | 9.60 | 9.65 |
| Oil Wt. Loss (gm)[20] | 11.60 | 18.70 |

Notes:
See TABLE 11.
[20]Difference between weight of oil at the beginning (about 120 ml) and end of testing the example.
[21]HiTEC 313 Extreme Pressure Additive, available from Ethyl Corporation, Richmond, Virginia, a sulfonated polyisobutylene having a number average molecular weight higher than about 310
[22]HiTEC 637 Performance Additive, dispersant which contains boron and other ingredients, manufactured by Ethyl Corporation, Richmond, Virginia The data of Table 12 shows good carbon/varnish and sludge performance for both unboronated dispersant and the combination of boronated and unboronated dispersants.

Examples 17–18

The data of Table 13 shows greater stability in the presence of added weight percent water for the concentrate which includes non-boronated dispersant.

TABLE 13

| | Example Nos. | |
|---|---|---|
| | 17 | 18 |
| SIB[1] | 40.000 | 40.000 |
| C11-14 amine[2] | 4.850 | 4.850 |
| Oleylamine[3] | 2.000 | 2.090 |
| AAP[4] | 7.000 | 7.000 |
| Unboronated Succinimide A[8] | 20.000 | |
| Boronated Succinimide[23] | 20.00 | |
| Process Oil #5[10] | 26.150 | 26.150 |
| Visual Appearance of Concentrate Plus 1 wt % distilled water | Clear | Cloudy |

Notes:
See TABLE 12
[23]Boronated 1300 MW polybutenyl succinimide, produced from acylating polyisobutylene with maleic anhydride and reacting the acylated hydrocarbon with polyethylene amines. The resulting succinimide is reacted with boric acid to yield a boronated succinimide.

After 36 days the product of Example 17 was still clear and the product of Example 18 was heavy precipitate.

It should be apparent that the many modifications may be made to the above-described embodiments and yet, still come within the spirit and scope of the present invention.

Thus, the present invention is not limited by the above-described embodiments. Rather, the present invention is defined by the claims appended hereto.

What is claimed is:

1. A clean gear boron-free lubricating oil additive concentrate comprising:

a boron-free ashless dispersant selected from at least one member of the group consisting of a hydrocarbyl substituted succinimide, a hydrocarbyl substituted succinic acid and a hydrocarbyl substituted succinamide;

wherein the hydrocarbyl substituted succinimide is selected from at least one member of the group consisting of compounds of Formula IIa and IIb:

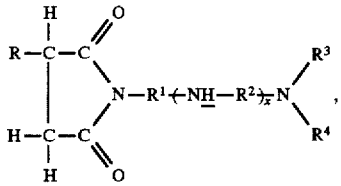

IIa

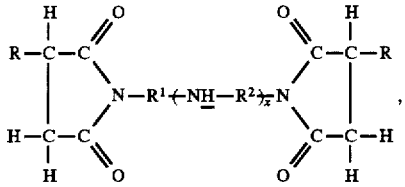

IIb wherein R is a polyalkylene moiety, $R^1$ is an alkyl having 1 to 10 carbon atoms, $R^2$ is an alkyl having 1 to 10 carbon atoms, $R^3$ is selected from the group consisting of H and an alkyl having 1 to 10 carbon atoms, $R^4$ is selected from the group consisting of H and an alkyl having 1 to 10 carbon atoms, and x is an integer from 2 to 8;

there being an absence of a succinimide compound wherein a single nitrogen atom is bound to H and two carbonyl groups;

a sulfur source selected from at least one member of the group consisting of sulfurized polyisobutylene and polysulfide; and a phosphorous source selected from at least one member of the group consisting of oil-soluble amine salts of the Formula IV:

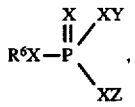

IV wherein $R^6$ is a hydrocarbyl group having 4 to 10 carbon atoms, each X is independently S or O, Y is $^+NH_3R^7$ or H, wherein $R^7$ is a hydrocarbyl group having 8–22 carbon atoms, and Z is $R^6$, $^+NH_3R^8$ or H, wherein $R^8$ is a hydrocarbyl group having 8–22 carbon atoms, with the proviso that at least one of Y and Z is $^+NH_3R^7$ or $^+N_3R^8$ respectively;

wherein the proportions of the dispersant, the sulfur source and the phosphorous source are selected such that a lubricating oil comprising a gear oil base stock, the dispersant, the sulfur source and the phosphorous source, has an L-60-1 carbon/varnish rating of at least about 7.5 and an L-60-1 sludge rating of at least about 9.4 when the total of the ashless dispersant, the sulfur source and the phosphorous is about 1 to about 10 weight percent of the lubricating oil.

2. The additive concentrate of claim 1, wherein the boron-free ashless dispersant is selected from the group consisting of compounds Formula IIa and IIb.

3. The additive concentrate of claim 1, wherein the oil has an L-60-1 carbon/varnish rating of from about 7.5 to about 10.

4. The additive concentrate of claim 1, wherein the oil has an L-60-1 sludge rating of from about 9.4 to about 10.

5. The additive concentrate of claim 2, wherein R is a polyisobutylene moiety having a number average molecular weight of about 750 to about 2500.

6. The additive concentrate of claim 2, wherein $R^1$ is $(CH_2)_n$ wherein n is an integer from 1 to 5, $R^2$ is $(CH_2)_m$ wherein m is an integer from 1 to 5, x is 2 to 5, $R^3$ is H or an alkyl having from 1 to 5 carbon atoms, and $R^4$ is H or an alkyl having from 1 to 5 carbon atoms.

7. The additive concentrate of claim 2, wherein the sulfur source is sulfurized polyisobutylene.

8. The additive concentrate of claim 2, wherein R is a polymer of at least one mono-olefin having from 2 to 30 carbon atoms per mono-olefin.

9. The additive concentrate of claim 2, wherein R is a polymer of at least one mono-olefin having from 2 to 8 carbon atoms per mono-olefin.

10. The additive concentrate of claim 1, wherein the phosphorous source has the formula:

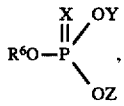

wherein $R^6$, X, Y and Z are defined as in Formula IV.

11. The additive concentrate of claim 2, wherein the phosphorous component comprises a mixture of compounds of both the following Formula VII and Formula VIII:

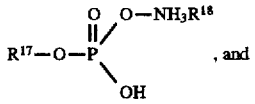

VII

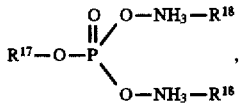

VIII wherein $R^{17}$ is a hydrocarbyl group having 2 to 12 carbon atoms and $R^{18}$ is independently a hydrocarbyl group having 4–30 carbon atoms.

12. The additive concentrate of claim 11, wherein the weight ratio of compound of Formula VII to compound of Formula VIII is 80:20 to 20:80.

13. The additive concentrate of claim 11, wherein $R^{17}$ is a hydrocarbyl group of about 4 to about 10 carbon atoms.

14. The additive concentrate of claim 1, further comprising at least one member of the group consisting of defoamers, demulsifiers, sulfur scavengers and antioxidants.

15. A clean gear capable lubricating oil comprising:

a base oil; and the additive concentrate of claim 1.

16. The lubricating oil of claim 15, wherein the boron-free ashless dispersant is selected from the group consisting of compounds of Formulas IIa and IIb.

17. The lubricating oil of claim 15, wherein the total of the ashless dispersant, the sulfur source and the phosphorous is from about 1 to about 10 weight percent of the lubricating oil.

18. The lubricating oil of claim 16, wherein R is a polyisobutylene moiety having a number average molecular weight of about 750 to about 2500.

19. The lubricating oil of claim 16, wherein the lubricating oil comprises about 0.26 to about 3.0 weight percent of the ashless dispersant, about 1 to about 5.25 weight percent of the sulfur source, and about 0.1 to about 3 weight percent of the phosphorous source.

20. The lubricating oil of claim 17 wherein the phosphorous component comprises a mixture of compounds of both the following Formula VII and Formula VIII:

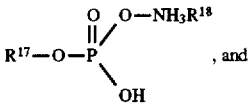

VII

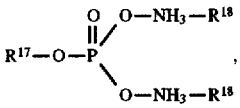

VIII wherein $R^{17}$ is a hydrocarbyl group having 4 to 10 carbon atoms and $R^{18}$ is independently a hydrocarbyl group having 8–22 carbon atoms.

21. A process for making the lubricating oil of claim 15, comprising combining the base oil and the additive concentrate.

22. A process for using the lubricating oil of claim 15, comprising lubricating a motor vehicle manual transmission with the lubricating oil.

23. A process for using the lubricating oil of claim 15, comprising lubricating a motor vehicle rear axle with the lubricating oil.

24. The additive concentrate of claim 1, wherein the dispersant consists essentially of the hydrocarbyl substituted succinamide.

25. The additive concentrate of claim 1, wherein the dispersant consists essentially of the hydrocarbyl substituted succinic acid.

26. The additive concentrate of claim 1, wherein the boron-free ashless dispersant is a mixture of a polyisobutylene succinimide-polyethylenepolyamine of Formula IIIa:

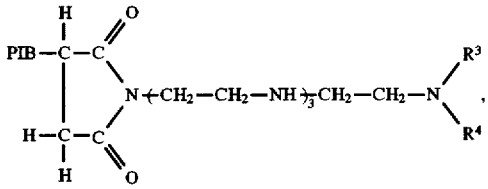

IIIa and a polyisobutylene succinimide-polyethylenepolyamine of Formula IIIb:

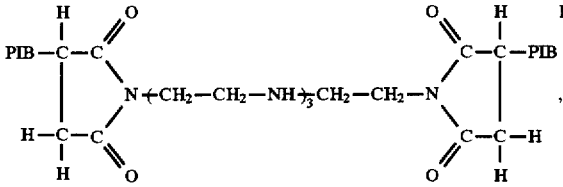

IIIb wherein, in Formulas IIIa and IIIb, PIB is polyisobutylene having a number average molecular weight of from 700 to 10,000, $R^3$ is H and $R^4$ is H.

* * * * *